US010677017B2

(12) United States Patent
Du et al.

(10) Patent No.: US 10,677,017 B2
(45) Date of Patent: Jun. 9, 2020

(54) SYSTEM AND METHODOLOGY FOR UTILIZING A FLOW CONTROL VALVE

(71) Applicant: Schlumberger Technology Corporation, Sugar Land, TX (US)

(72) Inventors: Michael Hui Du, Manvel, TX (US); Yves D. Loretz, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 467 days.

(21) Appl. No.: 15/102,252

(22) PCT Filed: Dec. 5, 2014

(86) PCT No.: PCT/US2014/068747
§ 371 (c)(1),
(2) Date: Jun. 6, 2016

(87) PCT Pub. No.: WO2015/085148
PCT Pub. Date: Jun. 11, 2015

(65) Prior Publication Data

US 2016/0319635 A1 Nov. 3, 2016

Related U.S. Application Data

(60) Provisional application No. 61/912,351, filed on Dec. 5, 2013.

(51) Int. Cl.
*E21B 34/10* (2006.01)
*E21B 43/12* (2006.01)
*E21B 43/14* (2006.01)

(52) U.S. Cl.
CPC ..... *E21B 34/10* (2013.01); *E21B 43/12* (2013.01); *E21B 43/14* (2013.01)

(58) Field of Classification Search
CPC combination set(s) only.
See application file for complete search history.

(56) References Cited

U.S. PATENT DOCUMENTS 3,307,568 A * 3/1967 Gartner ..... G05D 16/10 137/115.26
3,722,366 A * 3/1973 Richardson ..... B30B 15/20 91/170 R (Continued)

FOREIGN PATENT DOCUMENTS

EP 0923690 B1 10/2015

OTHER PUBLICATIONS

Search Report and Written Opinion of International Patent Application No. PCT/US2014/068747, dated Apr. 3, 2015, 11 pages.

(Continued)

*Primary Examiner* — Giovanna C Wright
*Assistant Examiner* — Ronald R Runyan

(57) ABSTRACT

A technique facilitates controlling fluid flow in a well system or other flow related system. The control of fluid flow may be accomplished by utilizing a flow control valve which is selectively actuated via the controlled application of an actuating fluid. An isolation valve is positioned along the flow of actuating fluid at a location upstream of the flow control valve. The isolation valve establishes a preset pressure which is applied to establish flow of actuating fluid to the flow control valve and also isolates detrimental pressure transients. For example, the isolation valve may be used to reduce or block the propagation of detrimental pressure transients along the actuating fluid to other controlled devices.

17 Claims, 4 Drawing Sheets

(56) References Cited

U.S. PATENT DOCUMENTS

| | | | | |
|---|---|---|---|---|
| 3,993,100 | A * | 11/1976 | Pollard | E21B 33/035 137/628 |
| 7,748,461 | B2 | 7/2010 | Loretz et al. | |
| 8,156,953 | B2 * | 4/2012 | Tveita | G05D 16/2033 137/102 |
| 8,186,444 | B2 | 5/2012 | Patel | |
| 2006/0254763 | A1 * | 11/2006 | Tips | E21B 23/04 166/65.1 |
| 2007/0163774 | A1 | 7/2007 | Hosatte et al. | |
| 2009/0065218 | A1 | 3/2009 | Loretz et al. | |
| 2013/0240212 | A1 | 9/2013 | Basmajian et al. | |

OTHER PUBLICATIONS

International Preliminary Report on Patentability of International Patent Application No. PCT/US2014/068747, dated Jun. 16, 2016, 8 pages.

Authors et. al.: Disclosed Anonymously, "Method and Apparatus of Hydraulic System for Flow Control Valves Operated in Multi-Zone Applications", ip.com; Jun. 12, 2012, 10 pages.

* cited by examiner

SYSTEM AND METHODOLOGY FOR UTILIZING A FLOW CONTROL VALVE

CROSS-REFERENCE TO RELATED APPLICATIONS

The present document is based on and claims priority to U.S. Provisional Application Ser. No. 61/912,351, filed Dec. 5, 2013, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completions may be deployed downhole and positioned along one or more well zones. Flow control devices, such as flow control valves, may be utilized to control flow along the well completions. Many types of flow control devices are controlled by hydraulic actuating fluid delivered via control lines. However, pressure transients, e.g. pressure fluctuations, in the control line can detrimentally impact other hydraulically actuated devices located along the well completion.

SUMMARY

In general, a system and methodology are provided for controlling fluid flow, e.g. fluid flow in a well. The control of fluid flow may be accomplished by utilizing a flow control valve which is selectively actuated via the controlled application of an actuating fluid. An isolation valve is positioned along the flow of actuating fluid at a location upstream of the flow control valve. The isolation valve establishes a preset pressure level, and the pressure of the supplied actuating fluid is raised above the preset pressure level to establish flow of actuating fluid to the flow control valve. The isolation valve also isolates detrimental pressure transients. For example, the isolation valve may be used to reduce or block the propagation of detrimental pressure transients along the actuating fluid to other controlled devices.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
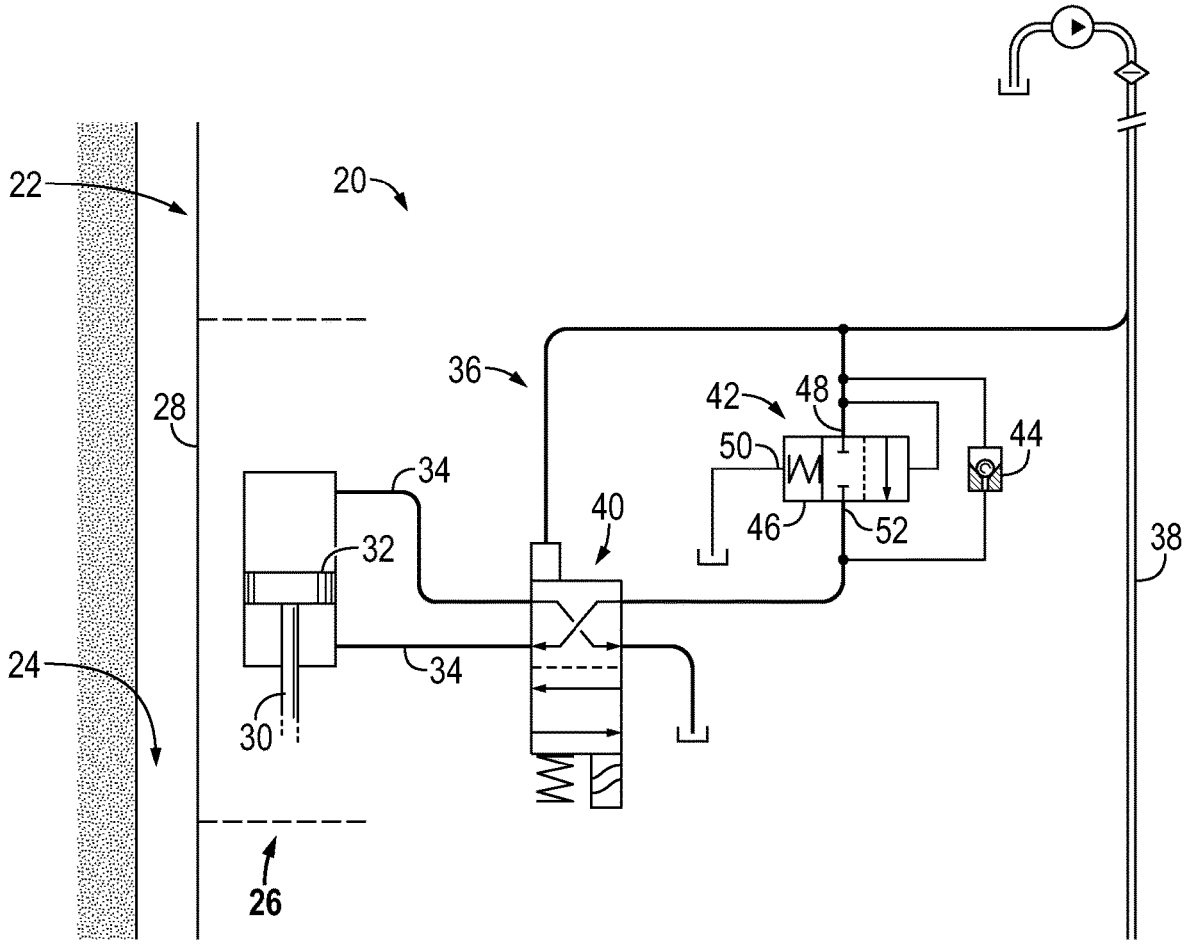
FIG. 1 is a schematic illustration of an example of a well system deployed in a borehole, the well system comprising a flow control assembly, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate various well operations or other operations by controlling fluid flow, e.g. controlling a primary fluid flow in a well. The control of fluid flow may be accomplished by utilizing a flow control valve which is selectively actuated via the controlled application of an actuating fluid. The actuating fluid may be the form of a hydraulic liquid delivered to the flow control valve via a control line. In a variety of well applications, a plurality of flow control valves may be located along a wellbore in different well zones. The individual flow control valves are actuated to control the flow of well fluid at the different well zones.

An isolation valve, e.g. a sequence valve, is used in cooperation with each flow control valve. For example, each isolation valve may be positioned along the flow of actuating fluid at a location upstream of a corresponding indexing device with respect to the supplied actuating fluid. The indexing device works in cooperation with a corresponding flow control valve. The isolation valve may be used to establish a preset pressure level. Pressure in the control line is raised above the preset pressure level to actuate the isolation valve and to thus enable flow of actuating fluid to the flow control valve. The isolation valve also may be used to isolate the actuating fluid within the control line from detrimental pressure transients. For example, the isolation valve may be used to reduce or block the propagation of detrimental pressure transients along the actuating fluid to other controlled devices, e.g. other flow control valves.

In an embodiment, a flow control assembly comprises a flow control valve and a sequence valve, the sequence valve having a reverse check valve. Flow control assemblies may be positioned along a well string for multi-zone flow control applications in which hydraulic fluid supplied by a hydraulic pump is used to actuate individual flow control valves in corresponding well zones. In this example, each flow control assembly comprises a flow control valve, an indexing device, e.g. a mini-indexer, and an isolation valve, e.g. a sequence valve, with a reverse check valve. Each sequence valve is installed upstream of the indexing device to isolate pressure transients introduced during actuation of a flow control valve, e.g. shifting of a flow control valve piston. Upstream refers to upstream along the supplied actuating fluid controlled by the isolation valve and used to selectively actuate the flow control valve.

Without the isolation/sequence valve, the onset of movement in a flow control valve during actuation of the flow control valve can effectively drawdown fluid and pressure in the control line. This drawdown can lead to undesired pressure fluctuations in other zones connected to the same control line. In some embodiments, the isolation valve may comprise a sequence valve having an inlet port, a reference pressure port, and an outlet port. The outlet port is placed in fluid communication with the inlet port when the inlet pressure exceeds a preset pressure level value relative to the reference pressure level.

In some applications, the mini-indexer or other suitable indexing device in each flow control assembly is used as a hydraulic switch which switches, for example, upon experiencing a pressure level or upon counting a predetermined number of pressure signals/pulses provided from the surface via the control line. In a multi-zone application, the indexing devices often do not make the switches at the same time due to differences between the indexing devices and differences in the well conditions at the various well zones. When one of the indexing devices switches, the hydraulic actuating fluid is suddenly exposed to a low-pressure region due to the shifting piston in the corresponding flow control valve. Without the isolation valve, this low-pressure region causes a corresponding pressure drop in the hydraulic system, including a pressure drop in the control line.

If the control line is exposed to the pressure drop and the pressure drop exceeds a certain value, other indexing devices could interpret the pressure drop as part of a surface control signal and count the actuation cycle incorrectly. Then, when the pressure in the control line recovers upon completing actuation of the corresponding flow control valve, the increase in pressure could be counted as the next actuation signal by other indexing devices. As a result, the actuation of a given flow control valve could initiate false indexing cycles counted by the other indexing devices coupled along the control line. In embodiments described herein, the isolation valve is constructed and located to block these false pressure cycles and other detrimental pressure transients from propagating along the control line to other pressure actuated devices, e.g. other indexing devices and flow control valves. Consequently, the specific flow control assemblies are actuated in a more consistent and dependable manner based on proper counting of pressure signals imposed by a surface pump and/or other pressure signal control system.

Referring generally to FIG. 1, a well system 20 is illustrated as comprising a well string 22 deployed in a borehole 24, e.g. a wellbore. The well string 22 comprises a flow control assembly 26 and in some applications comprises a plurality of flow control assemblies 26 located at different well zones along borehole 24. In this example, the flow control assembly 26 comprises a flow control valve 28 which may be shifted to allow or block a primary flow of fluid, e.g. production fluid, along the well string 22. The flow control valve 28 is actuated between different flow positions via an actuator 30 which may comprise a piston 32 moved between different actuation positions via pressurized hydraulic fluid supplied via fluid lines 34 of a hydraulic circuit 36. The hydraulic circuit 36 is part of a control line 38 which provides pressurized hydraulic actuating fluid from a surface pump or other suitable device. The illustrated flow control assembly 26 also comprises an indexing device 40, e.g. a mini-indexer, and an isolation valve 42, e.g. a sequence valve. The flow control valve 28, indexing device 40, and isolation valve 42 are connected by hydraulic circuit 36 as illustrated.

In the embodiment illustrated, the isolation valve 42 comprises a reverse check valve 44 positioned to eliminate or reduce the false pressure pulses described above. Although isolation valve 42 may comprise a variety of valve configurations, the illustrated example utilizes isolation valve 42 in the form of a sequence valve 46. The isolation valve 42 comprises an inlet port 48, a reference pressure port 50, and an outlet port 52.

When the flow control valve 28 is to be shifted to a different operational position, the indexing device 40 is switched to a flow position via a pressure signal, e.g. a predetermined pressure level or number of pressure pulses, supplied via control line 38. For example, a surface pump may be used to provide the appropriate pressure signal. According to an example, when the pressure level supplied by control line 38 reaches a "switch pressure" of the indexing device 40, the indexing device 40 actuates and switches to a flow direction which allows actuating fluid to flow to flow control valve 28 and to actuate the flow control valve 28 via actuator 30. However, the isolation valve 42 is installed in hydraulic circuit 38 to establish a preset actuation pressure level, e.g. a preset actuation pressure which may be referred to as a preset sequence pressure. To enable the flow of pressurized actuating fluid to reach the indexing device 40, the preset sequence pressure of isolation valve 42 is first exceeded by increasing the pressure of actuating fluid supplied via control line 38. Exceeding the preset sequence pressure actuates the isolation valve 42 to an open flow position and thus allows the actuating fluid/pressure to reach the indexing device 40 and to flow through the indexing device 40.

In the example illustrated, the preset sequence pressure is established by a pressure differential between inlet port 48 and reference pressure port 50 of isolation valve 42. When the pressure at inlet port 48 relative to the reference pressure at reference pressure port 50 exceeds the preset sequence pressure, the isolation valve 42 is actuated. Once actuated, hydraulic fluid can pass through the isolation valve 42, through outlet port 52, through indexing device 30, and to flow control valve 28 so as to actuate the flow control valve 28.

During the process of actuating flow control valve 28, if the pressure upstream of the isolation valve 42 falls below the preset sequence pressure, the isolation valve 42 shifts to a closed position. Once the isolation valve 42 is closed, the pressure does not drop further in the control line 38, thus avoiding false pressure pulses. If the surface pump or other device providing pressurized actuating fluid along control line 38 continues to operate, the pressure upstream of the isolation valve 42 again rises to actuate the isolation valve 42, thus allowing pressurized actuation fluid to flow through indexing device 40 for actuation of the corresponding flow control valve 28 to a new actuation position. The reference pressure at reference pressure port 50 can be well pressure, a pressure related to well pressure, or another pressure established by a designated source.

Once the supply pressure of the actuating fluid supplied along control line 38 is removed, the higher pressure fluid downstream of the isolation valve 42 is released back to inlet port 48 through the reverse check valve 44. Consequently, the actuation of isolation valve 42 working in cooperation with reverse check valve 44 ensures that the unwanted pressure drops and other pressure transients do not propagate along the actuating fluid within control line 38. The reverse check valve 44, however, also enables controlled release of the downstream pressure so that the flow control assembly 26 may again be prepared for a subsequent actuation.

Figure 2:
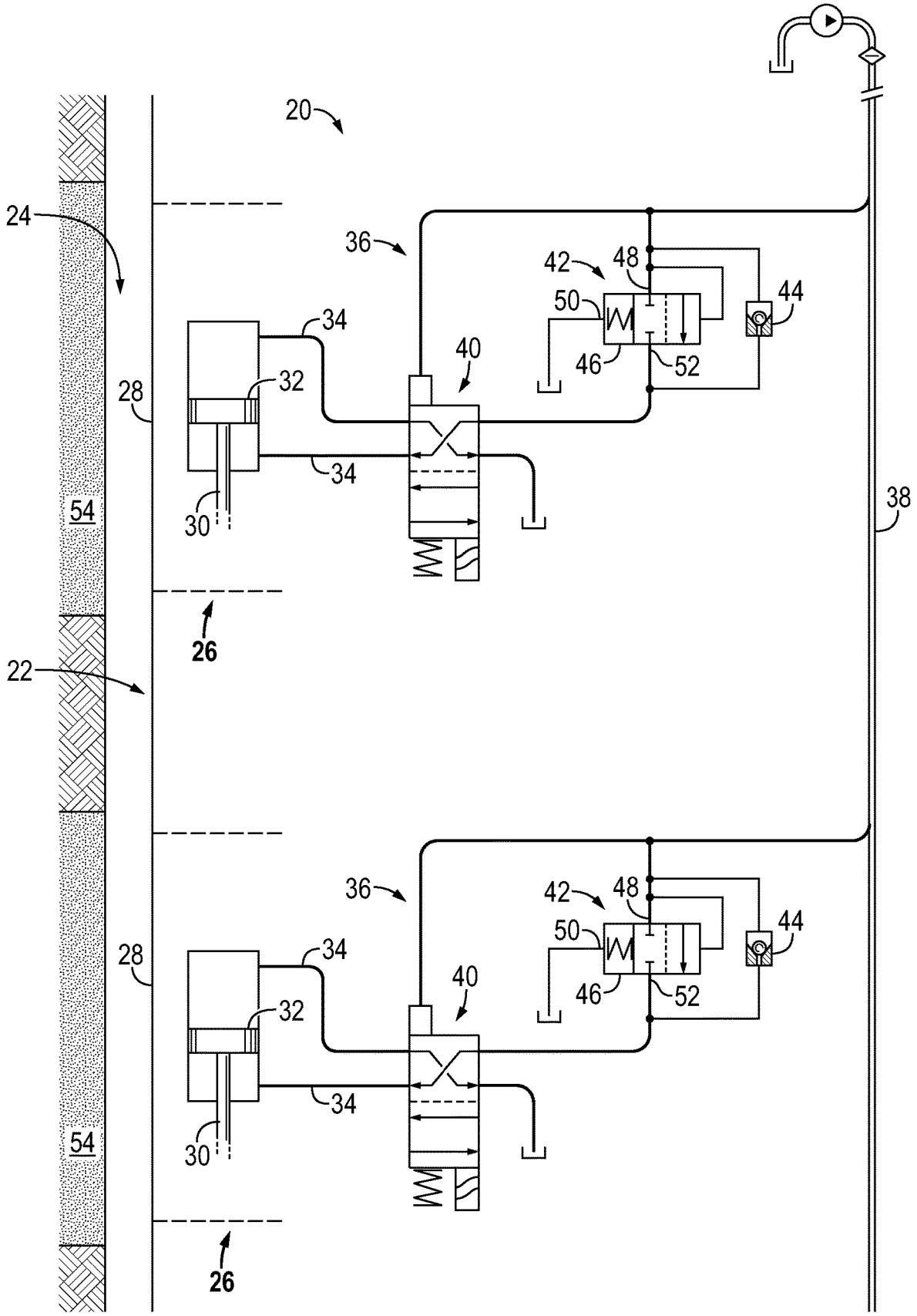
FIG. 2 is a schematic illustration of an example of a well system having a plurality of flow control assemblies, according to an embodiment of the disclosure.

Referring generally to FIG. 2, another embodiment is illustrated with a plurality of flow control assemblies 26 deployed along well string 22. Individual flow control assemblies 26 may be located along well string 22 at positions associated with corresponding well zones 54. As with the previous embodiment, various types of flow control valves 28, indexer devices 40, and isolation valves 42 may be employed in the individual flow control assemblies 26. For example, the isolation valves 42 may comprise a variety of sequence valves 46 or other types of valves which incorporate reverse check valves 44. In each of these embodiments, the isolation valve 42/reverse check valve 44 establish a preset pressure actuation level for providing actuating fluid to the corresponding flow control valve 28; block unwanted pressure drops and other pressure transients from acting on the actuating fluid within the control line 38; and enable controlled release of the high-pressure fluid located downstream of the isolation valve 42 once the pressure in control line 38 is sufficiently reduced.

When sequence valves 46 are employed in flow control assemblies 26, the cracking pressures of each sequence valve 46 in a given installation may be adjusted according to specific parameters. For example, the sequence valves 46 may be set collectively to actuate at roughly the same pressure. In other embodiments, however, the preset actuation pressure may be selected individually for each sequence valve 46 so as to enable a specific order of actuation with respect to the flow control assemblies 26 positioned along corresponding well zones 54. This latter embodiment can be helpful when bringing production or injection formations online in a prescribed fashion. Use of the specific order of actuation avoids undesirable pressure spikes in the well that could otherwise adversely affect the reservoir or equipment in the well string 22.

Figure 3:
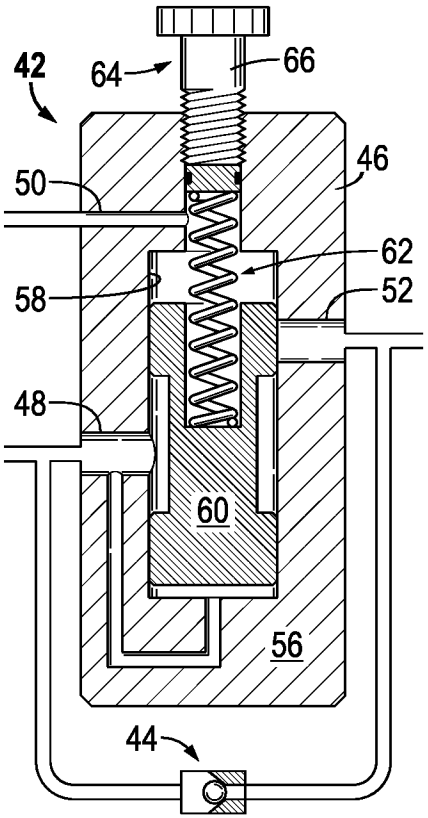
FIG. 3 is a schematic illustration of an example of an isolation valve which may be used in the flow control assembly, according to an embodiment of the disclosure.

Referring generally to FIG. 3, an example of isolation valve 42 is illustrated. In this example, the isolation valve 42 is in the form of sequence valve 46 having reverse check valve 44. As illustrated, the sequence valve 46 comprises a manifold 56 having an internal cavity 58 in which a sequence piston 60 is slidably received. The piston 60 is acted on by a bias spring 62 oriented to bias piston 60 in a given direction as illustrated. The manifold 56 further comprises inlet port 48, reference pressure port 50 (sometimes referred to as a drain port), and outlet port 52. In this example, the reverse check valve 44 is connected between inlet port 48 and outlet port 52.

When the inlet pressure at inlet port 48 is increased enough to overcome the force exerted by bias spring 62 and the pressure acting on reference pressure port 50, the sequence piston 60 is shifted (upwardly in the illustrated example). In other words, the pressure at inlet port 48 relative to reference pressure port 50 is increased above the preset actuation pressure for actuating sequence valve 46 and thus actuating flow control valve 28. Specifically, the shifting of piston 60 to an open flow position fluidly couples the inlet port 48 with the outlet port 52. This open flow position allows the pressurized actuating fluid to pass to flow control valve actuator 30 and to shift the flow control valve 28 to another operational position, provided the indexing device 40 has been indexed to an appropriate flow-through position.

If the pressure at the inlet port 48 drops a sufficient amount, the bias spring 62 moves piston 60 back to the position illustrated in FIG. 3 in which the outlet port 52 is disconnected from the inlet port 48. The piston 60 continues to block flow between inlet port 48 and outlet port 52 until the pressure at inlet port 48 is once again increased above the preset actuation level established by bias spring 62 and the pressure acting at reference pressure port 50. For example, flow of actuating fluid through the sequence valve 46 may be blocked until a subsequent actuation of the flow control valve 28 is desired.

In some applications, the pressure drop at inlet port 48 may be caused by removing the supply pressure of the actuating fluid supplied along control line 38. At this stage, the higher pressure fluid located downstream of the sequence valve 46 is released back to inlet port 48 through the reverse check valve 44. Consequently, the reverse check valve 44 ensures controlled release of the higher pressure fluid downstream of the sequence valve 46 while protecting the upstream actuating fluid and control line 38 from unwanted pressure drops and other pressure transients.

According to some embodiments, the sequence valve 46 (or other type of isolation valve 42) comprises an adjustment mechanism 64 which may be used to adjust the force of spring 62 acting on piston 60. By adjusting the force of spring 62 acting on piston 60, the preset actuation pressure can be changed, e.g. lowered or raised, according to the parameters of a given application. The adjustment mechanism 64 also enables setting of different preset actuation pressures at different flow control assemblies 26 to facilitate the ordered actuation of flow control valves 28 at different well zones 54. In the illustrated example, the adjustment mechanism 64 comprises an adjustment screw 66 which may be threaded inwardly or outwardly to adjust the compression of spring 62 and thus the force exerted by spring 62 on piston 60.

Figure 5:
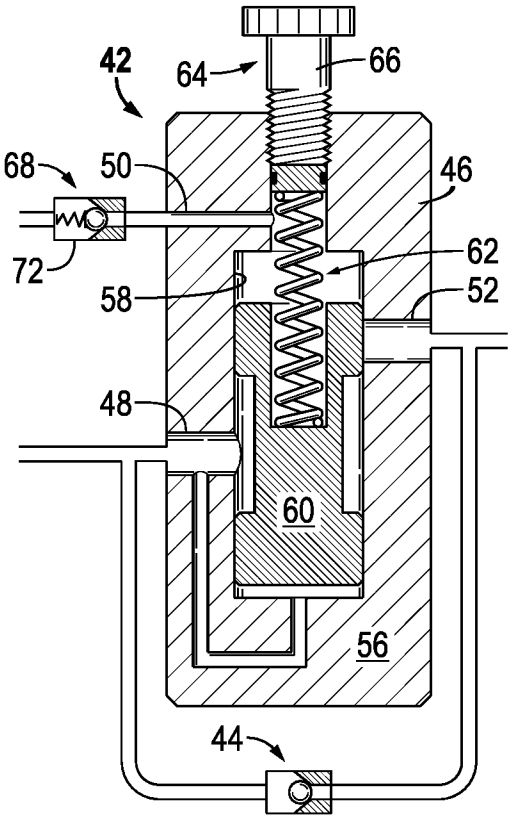
FIG. 5 is a schematic illustration of another example of an isolation valve which may be used in the flow control assembly, according to an embodiment of the disclosure.
Figure 4:
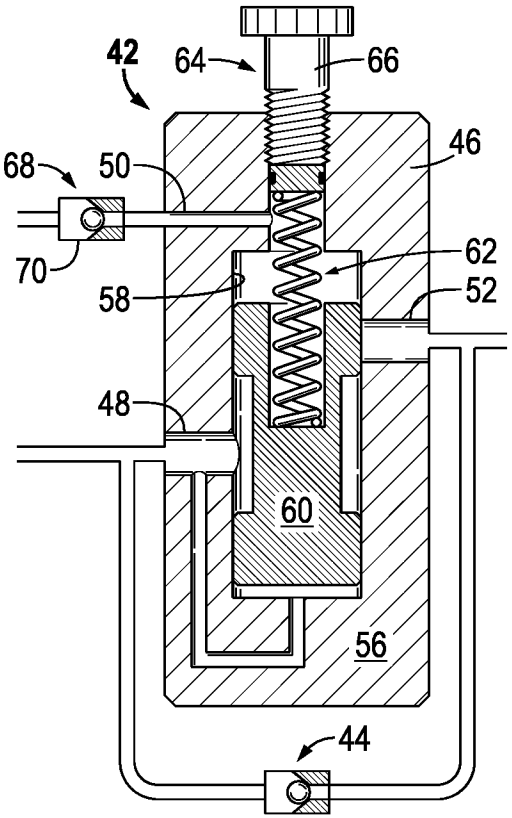
FIG. 4 is a schematic illustration of another example of an isolation valve which may be used in the flow control assembly, according to an embodiment of the disclosure.

In various well applications, the reference pressure port 50 may be in fluid communication with a well fluid. A protection mechanism 68 may be coupled with the reference pressure port 50 to protect the reference pressure port 50 from the well fluid, e.g. from pressure transients in the well fluid. As illustrated in FIG. 4, the protection mechanism 68 may comprise a drain port check valve 70. In other applications, the protection mechanism 68 may comprise a relief valve 72 coupled with the reference pressure port 50, as illustrated in FIG. 5.

Figure 7:
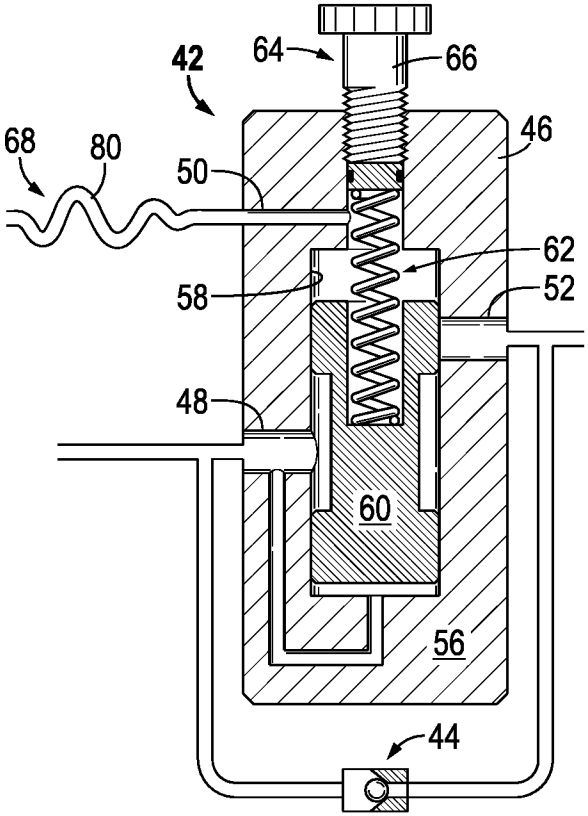
FIG. 7 is a schematic illustration of another example of an isolation valve which may be used in the flow control assembly, according to an embodiment of the disclosure.
Figure 6:
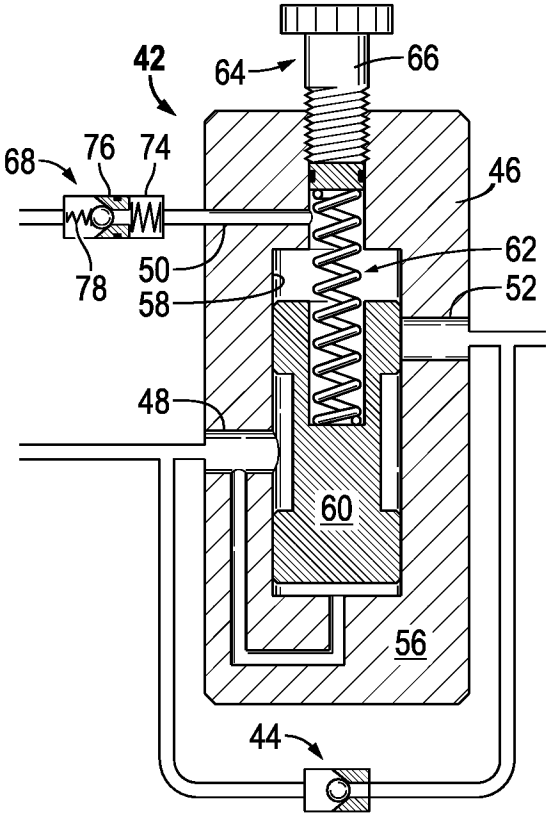
FIG. 6 is a schematic illustration of another example of an isolation valve which may be used in the flow control assembly, according to an embodiment of the disclosure.

Depending on the application, the protection mechanism 68 also may comprise a compensated relief valve 74 coupled with the reference pressure port 50, as illustrated in FIG. 6. By way of example, the compensated relief valve 74 may comprise a relief valve piston 76 which floats between the well fluid side and the sequence valve side while being biased by a relief valve spring 78. The relief valve spring 78 may be oriented to bias the relief valve piston 76 toward the sequence valve side. As illustrated in FIG. 7, however, some applications may utilize a simpler protection mechanism 68 such as an extended piece of tubing 80.

The flow control assembly or assemblies 26 may be used in a variety of well and non-well related applications. In various well applications, the flow control assemblies 26 may be used in cooperation with a pressure-pulse counting controller for selectively actuating flow control valves 28 at multiple well zones before. In many applications, the flow control assemblies 26 described herein provide a more predictable and reliable system which utilizes the dynamic pressure control provided by the sequence valves 46. The embodiments described herein also reduce flow control valve operation/shifting time especially for operations which use flow control valves 28 having relatively large stroke volumes.

Controlling the pressure transients also lowers risk of damage to choke seals during shifting of the flow control valves 28. Use of the reverse check valve 44 also prevents trapped pressures within the flow control valve assemblies. Reducing trapped pressures and undesirable pressure transients is beneficial in improving the reliability of many types of well systems, including intelligent, multi-zone flow control systems.

The overall well system 20 may have a variety of components and configurations. For example, the well system 20 may comprise numerous types of completions for use in a variety of well environments. Additionally, various numbers of flow control assemblies 26 may be used to control the flow of fluid with respect to a plurality of corresponding well zones 54. In production applications, the flow control assemblies may be used in combination with many other production completion components to control the flow of production fluid from the corresponding well zones 54.

Similarly, the individual flow control assemblies 26 may comprise various other and/or additional components. For example, various types of actuator pistons or other actuators may be used in the flow control valves 28, indexing devices 40, and/or isolation valves 42. Many applications utilize the indexing devices 40, but some applications may omit the indexing devices or use other types of controllable devices in cooperation with the corresponding flow control valve 28 and isolation valve 42 in each flow control assembly 26. Additionally, the materials used in constructing the flow control assemblies 26 as well as the size and configuration of the individual flow control assemblies 26 may vary according to the parameters of a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling flow in a well, comprising:

a well string located in a wellbore, the well string having:

a flow control valve positioned to control a fluid flow along the wellbore, the flow control valve being actuated via an actuator by an actuating fluid supplied via a control line;

an indexing device controlling flow of the actuating fluid to the flow control valve;

a sequence valve in fluid communication with the indexing device and the control line, the sequence valve being installed upstream of the indexing device in a manner which isolates pressure transients introduced into the control line during actuation of the flow control valve, the sequence valve blocking flow to the indexing device until the sequence valve is actuated to an open flow position by increasing pressure of the actuating fluid acting on the sequence valve, via the control line, to a level exceeding a preset sequence pressure, the sequence valve comprising an inlet port, a reference pressure port, and an outlet port; and a reverse check valve configured to block unwanted pressure drops in the control line when the flow control valve is actuated and configured to allow controlled release of higher pressure fluid located downstream of the sequence valve to the inlet port or upstream of the sequence valve.

2. The system as recited in claim 1, wherein the sequence valve comprises a piston slidably mounted in a manifold and biased toward a predetermined position by a spring, the manifold having the inlet port, the reference pressure port, and the outlet port.

3. The system as recited in claim 2, wherein the inlet port and the outlet port are selectively placed in fluid communication by shifting the piston via pressure in the control line.

4. The system as recited in claim 1, wherein the sequence valve comprises an adjustment mechanism enabling adjustment of a preset sequence pressure at which the sequence valve is actuated.

5. The system as recited in claim 1, further comprising a check valve positioned to protect the reference pressure port.

6. The system as recited in claim 1, further comprising a relief valve positioned to protect the reference pressure port.

7. The system as recited in claim 1, further comprising a compensated relief valve positioned to protect the reference pressure port.

8. The system as recited in claim 1, further comprising a tubing section positioned to protect the reference pressure port.

9. The system as recited in claim 1, wherein the well string extends through a plurality of well zones, each well zone having at least one of the flow control valve, the indexing device, and the sequence valve.

10. A method for controlling flow in a well, comprising:

positioning a flow control valve to control a flow of primary fluid, the flow control valve comprising an actuator configured to be moved between different actuation positions by an actuating fluid;

controlling a flow of the actuating fluid to the flow control valve with an indexing device;

locating an isolation valve upstream of the indexing device, the isolation valve having an inlet port, a reference pressure port, and an outlet port formed in a manifold; and using the isolation valve to block flow of the actuating fluid to the indexing device until the isolation valve is actuated to an open flow position by increasing pressure of the actuating fluid acting on the isolation valve to a level exceeding a preset actuation pressure, the isolation valve thus serving to isolate detrimental pressure transients introduced into the actuating fluid during actuation of the flow control valve, and using a reverse check valve to isolate the detrimental pressure transients and to provide controlled release of higher pressure fluid located downstream of the isolation valve to the inlet port or upstream of the isolation valve.

11. The method as recited in claim 10, wherein locating comprises locating a sequence valve.

12. The method as recited in claim 10, further comprising using a piston within the manifold to control fluid communication between the inlet port, the reference pressure port, and the outlet port.

13. The method as recited in claim 12, further comprising using an additional valve in combination with the reference pressure port.

14. A system, comprising:

a well string deployed in a wellbore located along a plurality of well zones, the well string comprising:

a plurality of flow control assemblies, each flow control assembly having:

a flow control valve actuated by an actuating fluid;

an isolation valve located upstream of the flow control valve with respect to flow of the actuating fluid, the isolation valve blocking flow of the actuating fluid to an indexing device until the isolation valve is actuated to an open flow position by increasing pressure of the actuating fluid acting on the isolation valve to a level exceeding a preset actuation pressure, thus isolating detrimental pressure transients introduced into the actuating fluid during actuation of the flow control valve; and a reverse check valve oriented to block unwanted pressure drops in the actuating fluid when the flow control valve is actuated, the reverse check valve disposed in a fluid flow line extending from downstream of the isolation valve to upstream of the isolation valve.

15. The system as recited in claim 14, wherein the isolation valve is in the form of a sequence valve having a piston slidably mounted in a manifold and selectively movable to control fluid communication between an inlet port and an outlet port.

16. The system as recited in claim 14, the reverse check valve configured to allow controlled release of higher pressure fluid downstream of the isolation valve through the reverse check valve to upstream of the isolation valve.

17. The system as recited in claim 15, the reverse check valve configured to allow controlled release of higher pressure fluid downstream of the isolation valve through the reverse check valve to the inlet port.

* * * * *